United States Patent [19]

Claeys et al.

[11] Patent Number: 4,820,608

[45] Date of Patent: Apr. 11, 1989

[54] DYE DIFFUSION TRANSFER IMAGING PROCESS AND IMAGE RECEPTOR USED THEREIN

[75] Inventors: Daniël A. Claeys; Daniël M. Timmerman, both of Mortsel; Antonius A. Rutges, Boechout; Eddy A. Michiels, Kontich; Luc J. Vanmaele; Piet Kok, both of Ghent, all of Belgium

[73] Assignee: AGFA-Gevaert, N.V., Mortsel, Belgium

[21] Appl. No.: 110,797

[22] Filed: Oct. 21, 1987

[30] Foreign Application Priority Data

Oct. 23, 1986 [EP] European Pat. Off. ..... 86201855

[51] Int. Cl.[4] ..... G03C 5/54

[52] U.S. Cl. ..... 430/213; 430/214; 430/216; 430/219; 430/237; 430/238; 430/941

[58] Field of Search ..... 430/213, 214, 216, 219, 430/212, 941, 237, 238

[56] References Cited

U.S. PATENT DOCUMENTS

| | | | |
|---|---|---|---|
| 3,260,597 | 7/1966 | Weyerts et al. | 430/219 |
| 3,265,498 | 8/1966 | Rogers et al. | 430/219 |
| 3,271,147 | 9/1966 | Bush | 430/213 |
| 3,787,209 | 1/1974 | Land | 430/214 |
| 4,390,613 | 6/1983 | Mehta et al. | 430/219 |
| 4,448,878 | 5/1984 | Yamamuro et al. | 430/611 |
| 4,481,277 | 11/1984 | Pfingston | 430/214 |
| 4,543,317 | 9/1985 | Mehta et al. | 430/219 |

FOREIGN PATENT DOCUMENTS

| | | |
|---|---|---|
| 3500499 | 7/1985 | Fed. Rep. of Germany . |
| 1003671 | 8/1961 | United Kingdom . |

OTHER PUBLICATIONS

Chem. Abst. No. 99:131289t, pg. 555, vol. 99, 1983, Abstract of European Patent Application EP 80,631.

*Primary Examiner*—Richard L. Schilling

*Attorney, Agent, or Firm*—A. W. Breiner

[57] ABSTRACT

The present invention provides a dye diffusion transfer imaging process comprising transferring image-wise by diffusion an acid dye to an image-receiving layer incorporating a non-polymeric phosphonium mordanting agent and a copolymer latex comprising free weak acid groups as a stabilizer for the mordanting agent, wherein the image-wise transfer of said acid dye is performed in the presence of a heterocyclic compound corresponding to one of the following general formulae I, II, and III:

(I)

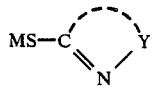

(II)

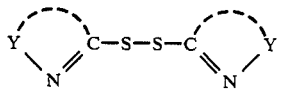

(III)

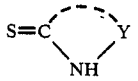

wherein:

Y represents the non-metallic atoms needed to complete a saturated or unsaturated 5- or 6-membered heterocyclic nucleus, which may carry a fused-on aromatic ring system, and M represents hydrogen, an alkali metal atom, a quaternary ammonium group, or a negative charge forming an inner salt with a quaternized nitrogen atom of the heterocyclic compound. The invention also provides an image receptor element for dye diffusion transfer imaging processes comprising a support and such image-receiving layer.

11 Claims, No Drawings

DYE DIFFUSION TRANSFER IMAGING PROCESS AND IMAGE RECEPTOR USED THEREIN

DESCRIPTION

The present invention relates to a dye diffusion transfer imaging process and to an image receptor element for use according to this process, said image receptor element comprising a support and an image-receiving layer incorporating a phosphonium mordanting agent, a copolymer latex comprising free acid groups, and a silver-complexing agent.

Such image-receiving layer can be coated on a support and form part of a non-light-sensitive receptor element that is to be brought in contact for development with a light-sensitive element comprising a support, at least one light-sensitive silver halide emulsion layer, and associated with said silver halide emulsion layer a non-diffusing dye-providing substance that is capable of releasing in image-wise distribution a diffusible dye upon development. Alternatively such image-receiving layer can also be an integrating constituent of a mono-sheet material comprising a light-sensitive element and an image receptor element. Any material can be employed as image-receiving layer in dye diffusion transfer imaging processes, provided it performs the desired function of mordanting or otherwise fixing the diffusing dye(s).

The dye(s) can be made to diffuse in image-wise distribution according to any known dye diffusion transfer imaging system. All dye diffusion transfer imaging systems are based on the same principle of modifying the solubility of the dyes as a function of the amount of photographic silver halide developed. In commonly known dye diffusion transfer imaging processes the dye-providing substances are either initially mobile in alkaline aqueous media and become immobilized during processing, or initially immobile and become mobilized during processing. A survey of such processes has been given by Christian C. Van de Sande in Angew. Chem.-Int. Ed. Engl. 22 (1983) no. 3, 191-209. More details on such processes and on dye-providing substances can be found in the literature cited therein and in DE-A Nos. 1,095,115; 1,930,215; 1,772,929; 2,242,762; 2,505,248; 2,543,902; 2,645,656; and the Research Disclosures Nos. 15,157 (November 1976) and 15,654 (April 1977).

The selection of the mordanting agent for mordanting or otherwise fixing the diffusing dye(s) is determined by the nature of the dye(s) to be mordanted. It is for instance known to mordant acid dyes with basic polymeric mordants such as polymers of amino-guanidine derivatives of vinyl methyl ketone as described in U.S. Pat. No. 2,882,156, basic polymeric mordants and derivatives like poly-4-vinylpyridine, the metho-p-toluene sulphonate of 2-vinylpyridine and similar compounds as described in U.S. Pat. No. 2,484,430. Unfortunately the colour densities obtained after mordanting of the diffused dye(s) by polymeric mordanting agents are insufficient.

Among the non-polymeric mordanting agents, ammonium salts have the disadvantage of impairing the physical characteristics of the hydrophilic colloid compositions, to which they have been added. Coating of such compositions is very difficult and, when the coating has succeeded at all, sticking problems often arise.

Other non-polymeric mordanting agents are the phosphonium salts, which are found to yield high colour densities upon reaction with diffusing dye(s). However, non-polymeric phosphonium salts have the disadvantage of bleeding, in other words of diffusing, mainly at high relative humidity from the image-receiving layer during storage before image formation therein towards the surface of the image-receiving layer or to a superjacent protective layer. Moreover, this bleeding can be aggravated after reaction of the non-polymeric phosphonium salts with ingredients contained in one of the processing baths e.g. an activating bath. As a result, the surface of the image-receiving layer or of the superjacent protective layer can become smeary and very susceptible to fingerprints.

To reduce this bleeding the mordanting agents can be stabilized by means of a hydrophilic organic colloid containing a finely-divided dispersion of a salt of an organic acidic composition containing free acid moieties as described in U.S. Pat Nos. 3,271,147 and 3,271,148. For instance, gelatin that has been acylated with a dicarboxylic acid can be used as stabilizer for the mordanting agent. Unfortunately, an image-receiving layer incorporating a phosphonium mordanting agent and organic acidic compositions containing free acid moieties, despite showing a reduced bleeding tendency, suffers from an overall yellow stain probably due at least in part to a deposition of colloidal silver, silver thiosulphate complexes, silver sulphide, and/or silver iodide during and/or after image formation.

It is therefore an object of the present invention to provide an improved image receptor comprising a non-polymeric phosphonium mordanting agent that yields high colour densities and is substantially fast to diffusion, said image receptor being less susceptible to the formation of yellow stain after image formation therein.

It is another object of the present invention to provide a light-sensitive colour photographic element comprising such improved image receptor element.

The above objects are accomplished by providing an image receptor element for dye diffusion transfer imaging processes comprising a support and an image-receiving layer incorporating a non-polymeric phosphonium mordanting agent, a polymer comprising free acid groups as a stabilizer for the mordanting agent, and a compound that is capable of forming colourless complexes with silver and/or silver salts, which complexes have a high stability to light and heat.

This compound forming colourless complexes will be called "silver-complexing agent" hereinafter.

According to the present invention an improved image receptor element for dye diffusion transfer imaging processes has been found, which comprises a support and an image-receiving layer incorporating:

a hydrophilic colloid, preferably gelatin, a non-polymeric phosphonium mordanting agent comprising at least one long chain hydrocarbon group and capable of fixing acid image dyes transferred to said image-receiving layer by diffusion, and a polymer comprising free acid groups, characterized in that said polymer is a copolymer latex comprising free weak acid groups and that said image-receiving layer also comprises at least one heterocyclic compound corresponding to one of the following general formulae I, II, and III:

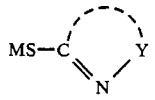
(I)

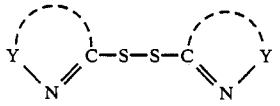
(II)

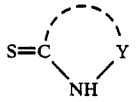
(III)

wherein:

Y represents the non-metallic atoms needed to complete a saturated or unsaturated 5- or 6-membered heterocyclic nucleus, which may carry a fused-on aromatic ring system, e.g. a fused-on benzene or naphthalene ring, and M represents hydrogen, an alkali metal atom such as sodium and potassium, a quaternary ammonium group, or a negative charge forming an inner salt with a quaternized nitrogen atom of the heterocyclic compound.

Most of the heterocyclic compounds corresponding to the above general formulae can also be employed in a precursor form. For instance mercapto-precursor compounds are well known in the art and have been described e.g. in U.S. Pat. Nos. 2,939,789; 3,311,474; 3,888,677; and 4,009,029. It is to be understood that the term "heterocyclic compound" as used herein is meant to include the precursor forms thereof as well.

The present invention also provides a monosheet light-sensitive colour photographic element comprising as integrating constituents a light-sensitive element and a said improved image receptor element.

The present invention furthermore provides a dye diffusion transfer imaging process comprising transferring image-wise by diffusion an acid dye to an image-receiving layer incorporating a non-polymeric phosphonium mordanting agent and a polymer comprising free acid groups as a stabilizer for the mordanting agent, characterized in that the image-wise transfer of said acid dye is performed in the presence of at least one heterocyclic compound corresponding to one of the above general formulae I, II, and III and that said polymer is a copolymer latex comprising free weak acid groups.

By the term "stabilizer" as used herein is meant an agent that immobilizes the non-polymeric phosphonium mordanting agent in the image-receiving layer so that it does not bleed during storage before and after image formation therein.

By the term "non-polymeric" as used herein is meant that the phosphonium cation of the phosphonium mordanting agent used according to the present invention does not comprise regularly recurring units containing the cationic group beyond the dimer structure. However, the long chain hydrocarbon group that makes part of the non-polymeric phosphonium mordanting agent may comprise repeating groups like polymethylene etc.

It has been established surprisingly that the yellow stain forming during and/or after image formation in the image-receiving layer comprising a phosphonium mordanting agent and a copolymer latex comprising free weak acid groups as stabilizer can be substantially reduced when the image formation in this image-receiving layer can take place in the presence of an above-mentioned heterocyclic compound corresponding to one of the general formulae I, II, and III. It is experienced indeed that the silver-complexing agent enters into reaction with any silver and/or silver salts that may have migrated into the image-receiving layer during image formation and forms colourless complexes therewith, which have a high stability to light and heat and consequently do not convert slowly into yellow-coloured staining products. At the same time the non-polymeric phosphonium salts retain their capacity of yielding high colour densities whilst showing no bleeding tendency during storage and especially during storage at increased temperature and high relative humidity.

The non-polymeric phosphonium mordanting agents that can be used according to the present invention can be represented by the following general formula:

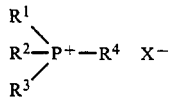

wherein:

each of $R^1$, $R^2$, and $R^3$ (same or different) represents a $C_1$–$C_8$ alkyl group e.g. n-butyl, a substituted $C_1$–$C_8$ alkyl group, a cycloalkyl group, an aryl group e.g. phenyl, or a substituted aryl group, $R^4$ represents an alkyl group having at least 10 carbon atoms e.g. n-hexadecyl and octadecyl, a substituted alkyl group having at least 10 carbon atoms, an alkenyl group having at least 10 carbon atoms e.g. 5,5,7,7-tetramethyl-2-octenyl, or a substituted alkenyl group having at least 10 carbon atoms, $X^-$ is an acid anion such as a halogen anion e.g. $Cl^-$, $Br^-$, and $I^-$, an anion derived from an inorganic acid e.g. $NO_3^-$, $HSO_4^-$, $SO_4^{--}$, $H_2PO_4^-$, $HPO_4^{--}$, $PO_4^{---}$, and an anion derived from a silver-complexing agent as defined above e.g.

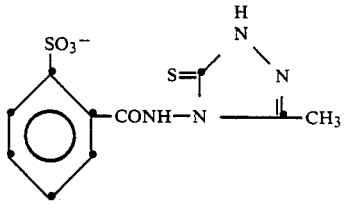

The $C_1$–$C_8$ alkyl groups represented by $R^1$, $R^2$, and $R^3$ can be straight chain or branched chain alkyl groups and the alkyl or alkenyl group having at least 10 carbon atoms, represented by $R^4$, can also be a straight chain or branched chain alkyl or alkenyl group.

Representatives of the non-polymeric phosphonium mordanting agents that can be used according to the present invention are listed in the following Table 1.

TABLE 1

P1 tri-n-butyl-n-octadecyl-phosphonium bromide
P2 tri-n-butyl-n-hexadecyl-phosphonium bromide
P3 triphenyl-n-hexadecyl-phosphonium bromide
P4 tri-n-butyl-5,5,7,7-tetramethyl-2-octenyl-phosphonium chloride P5 tri-n-butyl-n-hexadecyl-phosphonium iodide
P6 tri-n-butyl-n-hexadecyl-phosphonium hydrogen sulphate
P7 tri-n-butyl-n-hexadecyl-phosphonium sulphate
P8 tri-n-butyl-n-hexadecyl-phosphonium nitrate
P9 tri-n-butyl-n-hexadecyl-phosphonium dihydrogen phosphate
P10 tri-n-butyl-n-hexadecyl-phosphonium monohydrogen phosphate
P11 tri-n-butyl-n-hexadecyl-phosphonium phosphate
P12 tri-n-butyl-n-octadecyl-phosphonium salt of 3-methyl-4-(o-sulphobenzamido)-1,2,4-triazolin-5-thione A preferred non-polymeric phosphonium mordanting agent for use in accordance with the present invention is tri-n-butyl-n-hexdecyl-phosphonium bromide.

The phosphonium halides can be prepared by making alkyl halides react with trialkyl- or triaryl-phosphines. For instance, tri-n-butylphosphine is made to react with n-hexadecyl bromide to form tri-n-butyl-n-hexadecyl-phosphonium bromide. Phosphonium nitrates, phosphonium sulphates, and phosphonium phosphates can be prepared by converting a phosphonium bromide with potassium hydroxide into the corresponding phosphonium hydroxide and then allowing the latter to react with nitric acid, sulphuric acid, or phosphoric acid.

A wide variety of copolymer latices can be used as stabilizer to immobilize the non-polymeric phosphonium mordanting agent in the image-receiving layer so that it does not show any bleeding tendency.

Examples of copolymer latices comprising free weak acid groups, which can be used advantageously according to the present invention, are listed in the Table 2.

TABLE 2

| N° | Latex of | Ratio in % parts by weight | Ratio in mol % |
|---|---|---|---|
| L1 | co(n-butyl acrylate/acrylic acid) | 90/10 | 83.5/16.5 |
| L2 | co(n-butyl acrylate/acrylic acid) | 80/20 | 69.2/30.8 |
| L3 | co(n-butyl acrylate/acrylic acid) | 70/30 | 56.8/43.2 |
| L4 | co(n-butyl acrylate/acrylic acid) | 60/40 | 45.8/54.2 |
| L5 | co(n-butyl acrylate/methacrylic acid) | 80/20 | 72.9/27.1 |
| L6 | co(methyl methacrylate/acrylic acid) | 80/20 | 74.2/25.8 |
| L7 | co(methyl methacrylate/methacrylic acid) | 90/10 | 88.6/11.4 |
| L8 | co(methyl methacrylate/methacrylic acid) | 85/15 | 83.0/17.0 |
| L9 | co(methyl methacrylate/methacrylic acid) | 80/20 | 77.5/22.5 |
| L10 | co(styrene/acrylic acid) | 80/20 | 73.5/26.5 |
| L11 | co(styrene/methacrylic acid) | 80/20 | 76.8/23.2 |
| L12 | co(n-butyl acrylate/11-methacrylamido-undecanoic acid) | 80/20 | 89.4/10.6 |
| L13 | co(n-butyl acrylate/2-methacrylamido-5-methylsulphonamidophenol) | 60/40 | 76.0/24.0 |
| L14 | co(n-butyl acrylate/methacrylohydroxamic acid) | 80/20 | 75.9/24.1 |
| L15 | co(ethyl acrylate/methyl methacrylate/methacrylic acid) | 37/46.5/16.5 | 36.0/45.3/18.7 |

It is to be understood that the list of copolymer latices given above as well as the ratios given between the monomer units are in no way limitative. Many other copolymer latices can be used with success as stabilizer in accordance with the present invention, if only they comprise monomer units having free weak acid groups, such as carboxylic acid groups, phenol groups, hydroxamic acid groups, preference being given to carboxylic acid groups. The free weak acid groups can also be present at least partially in salt form and as a consequence the expressions "comprising free weak acid groups" and "comprising carboxylic acid groups" are meant to include the salt form in this specificaton. The copolymer latices preferably comprise 10 to 40 percent parts by weight of monomer units having free weak acid groups.

The copolymer latices can be prepared according to methods commonly known by those skilled in the art. Reference can be made in this respect e.g. to "Emulsions, Latices and Dispersions", edited by Paul Becher and Marvin N. Yudenfreund, 1978, Marcel Dekker Inc, New-York and Basel, and to "Emulsion Polymerisation Theory and Practice" by D. C. Blackley, 1975, Applied Science Publishers Ltd, London.

Although the stabilizer for the non-polymeric phosphonium mordanting agent in an image-receiving layer according to the present invention is normally a copolymer latex as defined above, it is possible to replace it partially by an organic substance comprising free weak acid groups, preferably carboxylic acid groups, e.g. the monobenzyl ester of 9-octadecen-1-yl-succinic acid or by a polymer comprising free weak acid groups, preferably carboxylic acid groups, e.g. polyacrylic acid.

Any heterocyclic compound corresponding to one of the above general formulae I, II, and III can be used as silver-complexing agent in accordance with the present invention provided it is capable of forming colourless complexes with silver and/or silver salts and provided the colourless complexes so formed have a high stability to light and heat.

The heterocyclic compound corresponding to one of the above general formulae I, II, and III comprises a heterocyclic nucleus, which can belong to one of i.a. the following classes: triazole. triazoline, triazolidine, triazolium, triazine, tetrazole, tetrazolidine, tetrazoline, imidazole, imidazolidine, imidazoline, pyrazole, pyrazolidine, pyrazoline, thiazole, thiazolidine, thiazoline, thiadiazole, thiadiazolidine, thiadiazoline, thiadiazine, oxazole, oxazolidine, oxazoline, oxadiazole, oxadiazolidine, triazine, thiadazine, pyridine, pyrimidine, pyridazine, piperazine, pyrazine. As mentioned before, the heterocyclic nucleus may carry a fused-on aromatic ring system, e.g. a fused-on benzene or naphthalene ring. The heterocyclic compound may carry substituents on the heterocyclic nucleus or on the fused-on benzene or naphthalene ring, if present. Examples of suitable substituents are $C_1$–$C_{18}$alkyl e.g. methyl and heptadecyl; substituted $C_1$–$C_{18}$alkyl e.g. hydroxyalkyl and carboxyalkyl; $C_1$–$C_{18}$alkoxy; substituted $C_1$–$C_{18}$alkoxy; alkenyl; substituted alkenyl e.g. allyl, aralkyl e.g. benzyl; substituted aralkyl; aryl: substituted aryl e.g. sulphobenzamidophenyl; alkoxycarbonyl; nitro; amino; substituted amino e.g anilino; acylamido e.g. benzamido; alkylureido; arylureido e.g. phenylureido; a halogen atom and water-solubilizing substituents such as e.g. sulpho, carboxy, and hydroxy, which can be used in acid or in salt form.

Representatives of heterocyclic compounds that can be used as silver-complexing agent in accordance with the present invention are listed in the following Table 3.

TABLE 3

No. Silver-complexing agent

S1 3-methyl-4-(o-sulphobenzamido)-1,2,4-triazolin-5-thione sodium salt
S2 4-(o-sulpho-benzamido)-1,2,4-triazolin-5-thione sodium salt
S3 3-hydroxymethyl-4-amino-5-mercapto-1,2,4-triazole
S4 3-methyl-4-amino-1,2,4-triazolin-5-thione
S5 3-mercapto-4-amino-1,2,4-triazole
S6 3-[p-(carboxymethylthioacetamido)-phenyl]-5-mercapto-4H-1,2,4-triazole
S7 3-heptadecyl-4-(m-sulphophenylureido)-1,2,4-triazolin-5-thione sodium salt
S8 3-methyl-4-(p-sulpho-anilino)-1,2,4-triazolin-5-thione ammonium salt
S9 3-(3-sulphopropyl)-thio-1,2,4-triazolin-5-thione potassium salt
S10 3-[p-(2-sulpho-benzamido)-phenyl]-1,2,4-triazol-2-in-5-thione
S11 1-H-1,2,4-triazolium-3-mercapto-1,4,5-trimethyl-hydroxide inner salt
S12 1-H-1,2,4-triazolium-3-mercapto-1,5-dimethyl-4-allyl-hydroxide inner salt
S13 2-p-sulphophenyl-5,6-dimethyl-1H,4H-1,2,4-triazin-3-thione sodium salt
S14 3-hydroxyethyl-1H,5H-1,3,5-triazin-6-thione
S15 1-morpholinomethyl-4-methyl-tetrazolin-5-thione
S16 1-ethyl-5-mercapto-tetrazole
S17 1-(m-carboxymethylthioacetamido)-phenyl-4H-tetrazolin-5-thione
S18 1-(m-sulphobenzamido)-phenyl-5-mercapto-tetrazole
S19 1-[p-(2-sulphobenzamido)-phenyl]-5-mercapto-tetrazole
S20 1-[m-(2-carboxybenzamido)-phenyl]-5-mercapto-tetrazole
S21 1-[m-(3-carboxypropionamido)-phenyl]-5-mercapto-tetrazole
S22 1-(m-carboxymethoxyacetamido)-phenyl-5-mercapto-tetrazole
S23 5-sulpho-benzothiazolin-2-thione
S24 6-(carboxymethylthioacetamido)-2-mercapto-benzothiazole
S25 2-mercapto-6-sulpho-benzoxazole sodium salt
S26 5-chloro-7-sulpho-benzoxazolidin-2-thione sodium salt
S27 5-(carboxymethylthioacetamido)-2-mercapto-benzoxazole
S28 5-(m-sulpho-benzamido)-benzoxazolin-2-thione
S29 imidazolidin-2-thione
S30 1-Betahydroxyethyl-imidazolidin-2-thione
S31 1-phenyl-imidazolidin-2-thione
S32 1-allyl-imidazolidin-2-thione
S33 sodium salt of 1-benzyl-5-sulpho-benzimidazolin-2-thione
S34 perhydro-pyrimidin-2-thione
S35 4-methyl-tetrahydropyrimidin-2-thione
S36 1-(2-hexadecylthio-5-sulpho-phenyl)-4,4,6-trimethyl-pyrimidin-2-thione
S37 1-m-sulphophenyl-4,4,6-trimethyl-3H-pyrimidin-2-thione
S38 7-sulpho-naphthoxazol-3-in-2-thione sodium salt
S39 5-decanamido-1,3,4-thiadiazole-2(3H)-thione
S40 1-m-decanamidophenyl-5-mercaptotetrazole Other heterocyclic compounds that can be taken into account for use as silver-complexing agent in accordance with the present invention can be found among the heterocyclic mercapto compounds of the type described in GB-Pat. No. 2,088,849 and in Research Disclosure 24236 (June 1984), the 1-(amidophenyl)-5-mercapto-tetrazole compounds of the type described in U.S. Pat. No. 3,295,976 and U.S. Pat. No. 3,708,303; the heterocyclic compounds of the type described in GB-Pat. No. 1,320,138, Research Disclosure 23630 (December 1983), U.S. Pat. No. 3,808,005; FR-Pat. No. 1,492,132; the heterocyclic mercapto or thioxo compounds of the type described in BE-Pat. No. 817,341 and in U.S. Pat. No. 3,645,738, the 1-phenyl-tetrazoles of the type described in the published JP-P Appl. 83-132,741, in U.S. Pat. No. 4,418,140, and in the published EP-P Appl. 0080631, which corresponds to the U.S. Ser. No. 441,208, now U.S. Pat. No. 4,448,878.

It has been experienced that heterocyclic compounds of the triazole, triazoline, triazolium inner salt, and triazine type as well as precursors thereof are excellent silver-complexing agents for use in accordance with the present invention, because they best suppress the formation of yellow stain in the image receptor upon image formation therein.

The heterocyclic compounds for use as silver-complexing agent in accordance with the present invention can be prepared according to methods commonly known by those skilled in the art. Reference can be made in this respect to the related patent literature and Research Disclosures mentioned hereinbefore.

The heterocyclic compounds for use as silver-complexing agent in accordance with the present invention can be incorporated into a layer of the image receptor element, preferably into the image-receiving layer. It is also possible to incorporate the heterocyclic compounds into a bath applied during the image-wise transfer by diffusion of an acid dye to the image-receiving layer comprising a non-polymeric phosphonium mordanting agent.

It is also possible to load the heterocyclic compounds onto the copolymer latices according to the technique of making loaded latices described in DE-A Nos. 2,541,230, 2,541,274, and in Research Disclosure 18815 (December 1979) and to incorporate the resulting loaded latices into a layer of the image receptor element according to the present invention. A suitable example of such a loaded latex that can be used in accordance with the present invention is copoly(butyl acrylate/acrylic acid)(80/20), which is loaded with the silver-complexing agent 3-methyl-4-(o-sulphobenzamido)-1,2,4-triazolin-5-thione sodium salt.

According to a special embodiment of the present invention the copolymer latex for use in accordance with the present invention comprises in addition to monomer units having free weak acid groups also at least one monomeric unit having the function of forming colourless complexes with silver and/or silver salts, in other words having the function of silver-complexing agent. The monomeric unit having the function of a silver-complexing agent can be in a precursor form, which can become active when entering in contact with an alkaline developing bath or other alkaline processing bath. It is obvious that since according to this special embodiment of the present invention the copolymer latex comprises silver-complexing monomer units by itself, no other silver-complexing agent need be present in the image receptor element. It is also possible, of course, to combine at least one copolymer latex comprising silver-complexing monomer units with at least one silver-complexing agent.

Copolymer latices comprising silver-complexing monomer units or the precursor form thereof can be prepared according to methods commonly known by those skilled in the art. Examples of the synthesis of monomeric compounds that can form complexes with silver and which are precursors to such compounds e.g. methacryloyloxyalkylisothiuronium salts can be found in GB Pat. No. 1,131,275.

Examples of copolymer latices comprising silver-complexing monomer units or the precursor form thereof are the following: Co(n-butyl acrylate/acrylic acid/2-(methacryloyloxy)-1-ethanethiol, Co(n-butyl acrylate/acrylic acid/2-[2-(methacryloyloxy)-ethyl] isothiuronium p-toluene sulphonate), the latter representative being a precursor form that is converted into the active thiol form when treated with an alkaline processing bath or other alkaline bath.

The hydrophilic colloid used as binder for the image-receiving layer is preferably gelatin. Gelatin can, however, at least in part be replaced by other hydrophilic film-forming polymers of natural or synthetic origin such as e.g. gum arabic, albumin, casein, dextrin, starch ethers or cellulose ethers, polyvinyl alcohol, succinoylated polyvinyl alcohol, partially phthaloylated polyvinyl alcohol, polyacrylamide, copolymers of acrylic acid, vinyl pyrrolidone, hydroxyethylacrylamide, vinyl pyridine, maleic acid or maleic acid anhydride with acrylamide.

The image-receiving layer may also contain other conventional ingredients such as ultraviolet-absorbing substances to protect the mordanted dye images from fading e.g. substituted 2-hydroxyphenyl-benzotriazoles and hydroxybenzophenones, brightening agents e.g. stilbenes, coumarins, triazines, oxazoles, or dye stabilizers e.g. tert.butyl-hydroxy-anisole, butylated hydroxytoluene, substituted chromanols, and alkyl-phenols, plasticizers etc.

The presence of a polymeric phosphonium mordanting agent in addition to the non-polymeric phosphonium mordanting agent, the copolymer latex and the silver-complexing agent the image-receiving layer was found to increase the maximum density in certain cases.

The non-polymeric phosphonium mordanting agent is incorporated into the image-receiving layer in amounts varying from about 0.5 to about 6 g per m2, preferably from about 1.5 to about 3 g per m2.

The copolymer latex comprising free weak acid groups for use as stabilizer for the mordanting agent is incorporated into the image-receiving layer in amounts varying from about 15 to about 150% by weight, preferably 30 to 70% by weight, calculated on the amount of non-polymeric phosphonium mordanting agent present.

The silver-complexing agent can be incorporated into the image-receiving layer in amounts varying from about 0.001 to about 10 mmol per m2.

The silver-complexing agent can also be incorporated into a bath applied during the image-wise transfer by diffusion of the acid dye to the image-receiving layer. In that case the silver-complexing agent is present in said bath in amounts varying from about 0.1 to about 200 mmol per litre. The bath comprising the silver-complexing agent can be a developing bath or any other processing bath such as an activating bath and a stabilizing bath.

The image-receiving layer can be coated directly onto the support or onto an adhesive layer or other layer previously applied to the support.

The support can be of any of the transparent or opaque support materials customarily employed in the art. They include paper or paper coated on one or both sides with an Alpha-olefin polymer e.g. polyethylene, glass, and film materials such as e.g. cellulose acetate film, polyvinyl acetal film, polystyrene film, polyethylene terephtalate film etc.

Good results are obtained e.g. when the image-receiving layer, which preferably is permeable to alkaline solution, has a thickness of approximately 2 to 10 μm. Of course, the thickness can be modified depending upon the results aimed at.

Lowering of the pH-value after formation of the dye image in the image-receiving layer usually leads to increased stability of the transferred dye image. In general, the pH of the layer can within a short time after imbibition be lowered from about 14–13 to 11 but preferably to 7–5. For instance, polymeric acids as disclosed in U.S. Pat. No. 3,362,819, or solid acids or metal salts. e.g. zinc acetate, zinc sulphate, magnesium acetate, etc., as disclosed in U.S. Pat. No. 2,584,030, can be employed successfully for that purpose.

The acid for lowering the pH can be incorporated into a layer, which can be coated with an inert timing or spacer layer that times or controls the pH-reduction proportionally to the rate, at which alkali diffuses through this inert spacer layer. Examples of such timing layers include gelatin, polyvinyl alcohol, or any of the colloids disclosed in U.S. Pat. No. 3,455,686. The timing layer can be effective in evening out the reaction rates over a wide range of temperatures. For instance, premature pH-reduction is prevented. when imbibition is effected at temperatures above room temperature. e.g. at 35° to 37° C. The thickness of the timing layer is usually comprised between approximately 2.5 and 18 μm . Especially good results are obtained when the timing layer comprises a hydrolysable polymer or a mixture of such polymers, which are hydrolysed slowly by the processing liquid. Examples of such hydrolysable polymers are e.g. polyvinyl acetate, polyamides, or cellulose esters.

After formation of the dye image in the image-receiving layer the pH-value can, of course, be lowered also by rinsing with water.

The image-receiving layer can be covered with a protective layer, preferably a gelatin protective layer.

For further information relevant to the composition of the image-receiving layer there can be referred to the above-mentioned U.S. Pat. No. 4,186,014.

The mordanting compositions used in accordance with the present invention can also be employed in hydrophilic colloid layers of a photographic element to mordant e.g. antihalation or filter dyes.

A wide variety of water-soluble acid dyes can be mordanted with the mordanting compositions of the present invention. Water-soluble acid dyes are well known materials to those skilled in the art. Such dyes comprise acid groups e.g. carboxylic. sulphonic, ionizable sulphonamido-and hydroxy-substituted aromatic or heterocyclic groups that lend negative charges to the dyes. Such anionic dyes can be readily immobilized by means of the cationic mordanting compositions of the present invention.

The following examples illustrate the present invention.

EXAMPLE 1

An image receptor element was made by coating a transparent polyethylene terephthalate film support having a thickness of 100 μm and subbed first with a polyurethane layer and next with a gelatin layer, with an image-receiving layer comprising per m2:

| | |
|---|---|
| gelatin | 5.0 g |
| phosphonium mordanting agent P2 of Table 1 | 2.3 g |
| copolymer latex L2 of Table 2 as stabilizer | 1.2 g |
| silver-complexing agent S1 of Table 3 | 0.7 mmol |

A negative colour diffusion material as described in the Example of U.S. Pat. No. 4,496,645 was exposed through a grey wedge having a constant of 0.1 and then developed while in contact with the image-receiving layer of the above image receptor element (called "Receptor 1" hereinafter) in a COPYPROOF T 42 diffusion transfer reversal processing apparatus (trade mark of AGFA-GEVAERT Belgium) containing an aqueous alkaline activating bath comprising per liter:

| | |
|---|---|
| sodium hydroxide | 25 g |
| sodium orthophosphate | 25 g |
| cyclohexane dimethanol | 25 g |
| sodium thiosulphate | 2 g |
| potassium iodide | 2 g |
| 2,2-methylpropylpropane diol | 25 g |
| N—ethylbenzene-pyridinium chloride | 0.5 g |
| distilled water to make | 1000 ml |

After a contact time of 2 min, Receptor 1 was separated from the negative material and rinsed and dried in a COPYPROOF WD 37 rinsing and drying apparatus (trade mark of AGFA-GEVAERT Belgium).

The above described procedure was repeated in exactly the same way with a number of image receptor elements (Receptors C1 to C5 and Receptors 2 to 8) that differ from the above described Receptor 1 only by the nature of the stabilizer and/or of the silver-complexing agent contained in the image-receiving layer thereof. For comparison purposes Receptor C1 comprising neither a stabilizer nor a silver-complexing agent, Receptor C2 comprising butyl acrylate as stabilizer (called "BA" in Table 4 hereinafter) and comprising no silver-complexing agent, and the Receptors C3 to C5 comprising a copolymer latex as stabilizer and no silver-complexing agent were entered in the test and treated in the same way as the receptors 1 to 8 according to the present invention, which comprised both a stabilizer and a silver-complexing agent.

The bleeding tendency of the phosphonium mordanting agent P2 was evaluated before image formation in the receptor elements but after a storage thereof for 4 days at 45° C. and a relative humidity of 70%. The bleeding tendency was checked again after image formation and subsequent storage of the receptor elements for 4 days at 45° C. and a relative humidity of 70%.

The bleeding tendency was checked visually. a value of 0 being attributed to a receptor showing no bleeding at all, a value of 1 standing for slight bleeding. 2 standing for moderate bleeding, 3 standing for considerable bleeding, a value of 4 standing for a very high bleeding.

The formation of yellow stain due to the deposition of colloidal silver and silver salts after image formation in the Receptors C1 and C5 and Receptors 1 to 8 was evaluated after storage for 4 days at 45° C. and a relative humidity of 70%.

The formation of yellow stain was measured in a MACBETH Densitometer RD 919 through a KODAK STATUS A blue filter.

The maximum density of some of the mordanted yellow, magenta, and cyan dyes obtained was measured in transmission in colour by means of a MACBETH QUANTOLOG Densitometer.

The results of the evaluations are listed in the following Table 4.

TABLE 4

| Receptor N° | Latex N° | Silver-complex. agent N° | Bleeding before image | after formation | Yellow stain | Maximum density Yellow | Magenta | Cyan |
|---|---|---|---|---|---|---|---|---|
| C1 | nil | nil | 4 | 4 | 24 | | | |
| C2 | BA | nil | 4 | 4 | 28 | | | |
| C3 | L2 | nil | 0 | 1 | 28 | 113 | 104 | 123 |
| C4 | L9 | nil | 1 | 2 | 27 | | | |
| C5 | L11 | nil | 1 | 2 | 26 | | | |
| 1 | L2 | S1 | 0 | 0 | 13 | 109 | 105 | 131 |
| 2 | L2 | S2 | 0 | 0 | 16 | 111 | 109 | 133 |
| 3 | L2 | S3 | 0 | 0 | 14 | 107 | 107 | 131 |
| 4 | L2 | S4 | 0 | 0 | 14 | | | |
| 5 | L2 | S5 | 0 | 0 | 14 | 108 | 108 | 130 |
| 6 | L2 | S7 | 0 | 0 | 15 | | | |
| 7 | L2 | S8 | 0 | 0 | 16 | | | |
| 8 | L2 | S17 | 0 | 0 | 20 | 112 | 107 | 129 |

These results show that the comparison Receptors C1 and C2 have a very high bleeding tendency both before and after image formation therein, whereas the comparison Receptors C3 to C5 comprising a copolymer latex but no silver-complexing agent, even though they show no bleeding or only a slight bleeding before image formation and a somewhat higher bleeding tendency after image formation, suffer from yellow stain to a far higher extent than the Receptors 1 to 8 comprising a phosphonium mordanting agent, a copolymer latex comprising free acid groups, and a silver-complexing agent according to the present invention. The Receptors 1 to 8 show no bleeding at all of the mordanting agent before as well as after the image formation and moreover they have a very low yellow stain after image formation and subsequent storage. It is also shown that these positive effects are not to the detriment of the maximum density values. The maximum density values obtained in the presence of a silver-complexing agent equal those obtained in the absence thereof.

EXAMPLE 2

An image receptor element was made by coating a subbed support as described in Example 1 with an image-receiving layer comprising per m2:

| | |
|---|---|
| gelatin | 5.0 g |
| phosphonium mordanting agent P2 of Table 1 | 2.5 g |
| copolymer latex L2 of Table 2 as stabilizer | 1.2 g |
| silver-complexing agent as specified in Table 5 | 0.3 mmol |

As described in Example 1 a negative colour diffusion material was exposed and then developed in contact with the image-receiving layer of the above image receptor element. After a contact time of 2 min, the image receptor element was separated from the negative material and rinsed and dried as described in Example 1.

The above described procedure was followed with a number of image receptor elements (Receptor C6 and Receptors 9 to 14) that differ from each other only by the nature of the silver-complexing agent contained in the image-receiving layer thereof. For comparison purposes Receptor C6 comprising no silver-complexing agent was entered in the test and treated in the same way as the receptors 9 to 14 according to the present invention, which all comprised a silver-complexing agent.

The maximum density of the mordanted yellow, magenta, and cyan dyes obtained was measured in transmission in colour by means of a MACBETH QUANTOLOG Densitometer.

The formation of yellow stain due to the deposition of colloidal silver and silver salts after image formation in the Receptors was evaluated in two different ways. In a first batch the stain was determined after a storage of 4 days in normal conditions, whereas in a second batch it was determined after a storage for 4 days at 45° C. and a relative humidity of 70%. The formation of yellow stain was measured as described in Example 1.

The results of the measurements are listed in the following Table 5.

TABLE 5

| Receptor N° | Silver-complexing agent N° | Maximum density | | | Yellow stain | |
|---|---|---|---|---|---|---|
| | | Yellow | Magenta | Cyan | norm. | 45° C./ 70% RH |
| C6 | nil | 112 | 109 | 137 | 27 | 30 |
| 9 | S1 | 111 | 110 | 140 | 16 | 16 |
| 10 | S7 | 111 | 109 | 137 | 14 | 15 |
| 11 | S8 | 112 | 109 | 138 | 15 | 18 |
| 12 | S13 | 117 | 106 | 130 | 15 | 15 |
| 13 | S26 | 108 | 110 | 136 | 15 | 20 |
| 14 | S38 | 110 | 109 | 139 | 16 | 22 |

These results show that both in normal storage conditions as well as in accelerated ageing conditions of the image receptor elements comprising image dyes the formation of yellow stain in the image receptor elements comprising a silver-complexing agent in addition to the phosphonium mordanting agent and the copolymer latex according to the present invention is considerably lower than in the image receptor element comprising no silver-complexing agent. At the same time it is shown that this positive effect is not accompanied by a substantial decrease in the high maximum density values that can normally be obtained with non-polymeric phosponium mordanting agents. The maximum density values obtained in the supplemental presence of silver-complexing agent substantially equal those obtained in the absence thereof. It was also found that the maximum density values obtained in the supplemental presence of silver-complexing agent are maintained during prolonged storage of the image, even in conditions of high temperature and relative humidity.

EXAMPLE 3

An image receptor element was made by coating a subbed support as described in Example 1 with an image-receiving layer comprising per m2:

| | |
|---|---|
| gelatin | 5.0 g |
| phosphonium mordanting agent P2 of Table 1 | 2.5 g |
| copolymer latex L15 of Table 2 as stabilizer | 1.2 g |
| silver-complexing agent S1 in an amount as specified in Table 6 | |

silver-complexing agent Sl in an amount as specified in Table 6

As described in Example 1 a negative colour diffusion material was exposed and then developed in contact with the image-receiving layer of the above image receptor element. After a contact time of 2 min, the image receptor element was separated from the negative material and rinsed and dried as described in Example 1.

The above described procedure was followed with five image receptor elements (Receptors 15 to 19) that differ from each other only by the amount of the silver-complexing agent Sl contained in the image-receiving layer thereof.

The values of maximum density and of yellow stain formed in normal storage conditions as well as in accelerated ageing conditions (4 days at 45° C. and a relative humidity of 70%) were measured as described in Example 2. The results of the measurements are listed in the following Table 6.

TABLE 6

| Receptor N° | Amount of compd. S1 in mg/m² | Maximum density | | | Yellow stain | |
|---|---|---|---|---|---|---|
| | | Yellow | Magenta | Cyan | norm. | 45° C./ 70% RH |
| 15 | 100 | 111 | 110 | 140 | 16 | 17 |
| 16 | 50 | 103 | 105 | 130 | 19 | 21 |
| 17 | 25 | 109 | 103 | 137 | 19 | 26 |
| 18 | 12.5 | 114 | 106 | 139 | 26 | 31 |
| 19 | 0 | 112 | 109 | 137 | 27 | 32 |

It is seen that the values of maximum density differ but very slightly with changing amounts of silver-complexing agent. In contrast, the formation of yellow stain increases significantly with decreasing amounts of silver-complexing agent both in normal storage conditions as well as in accelerated ageing conditions.

EXAMPLE 4

An image receptor element was made by coating a subbed support as described in Example 1 with an image-receiving layer comprising per m2:

| | |
|---|---|
| gelatin | 5.0 g |
| phosphonium mordanting agent P2 of Table 1 | 2.5 g |
| copolymer latex L2 of Table 2 as stabilizer | 1.2 g |

A negative colour diffusion material as described in Example 1 was exposed through a grey wedge having a constant of 0.1 and then developed while in contact with the image-receiving layer of the above image receptor element in a COPYPROOF T 42 diffusion transfer reversal processing apparatus (trade mark of AGFA-GEVAERT Belgium) containing an aqueous alkaline activating bath comprising per liter:

| | |
|---|---|
| sodium hydroxide | 25 g |
| sodium orthophosphate | 25 g |
| cyclohexane dimethanol | 25 g |
| silver-complexing agent as specified in Table 7 | $1.25 \times 10^{-2}$ mol/l |
| potassium iodide | 2 g |
| 2,2 methylpropylpropane diol | 25 g |
| N—ethylbenzene-pyridinium chloride | 0.5 g |
| distilled water to make | 1000 ml |

After a contact time of 2 min, the above image receptor element was separated from the negative material and rinsed and dried as described in Example 1.

The above described procedure was repeated in exactly the same way with other aqueous alkaline activating baths, which differed from the above-mentioned bath only by the nature of the silver-complexing agent contained therein. For comparison purposes Activating bath 1 contained no silver-complexing agent.

The formation of yellow stain due to the deposition of colloidal silver and silver salts after image formation in the image receptor elements was evaluated after a storage for 4 days at 45° C. and a relative humidity of 70%. The formation of yellow stain was measured as described in Example 1.

The maximum density of the mordanted yellow, magenta, and cyan dyes obtained was measured in transmission in colour by means of a MACBETH QUANTOLOG Densitometer.

The results of the measurements are listed in the following Table 7.

TABLE 7

| Activating Bath N° | Silver-complexing agent N° | Maximum density Yellow | Magenta | Cyan | Yellow stain |
|---|---|---|---|---|---|
| 1 | nil | 107 | 120 | 145 | 24 |
| 2 | S5 | 108 | 126 | 147 | 17 |
| 3 | S12 | 105 | 121 | 134 | 18 |
| 4 | S17 | 107 | 121 | 145 | 18 |

These results show that the formation of yellow stain due to the deposition of colloidal silver and/or silver salts after image formation in the image receptor elements is substantially less pronounced, when the image has been formed in the presence of a silver-complexing agent contained in the activator bath. Apparently, the silver complexes formed are found to be colourless and very stable to light and heat. This positive effect is not accompanied by a decrease in the high maximum density values that are normally obtained with non-polymeric phosponium mordanting agents. The maximum density values obtained in the presence of silver-complexing agent contained in the activator bath equal those obtained in the absence thereof.

We claim:

1. Image receptor element for dye diffusion transfer imaging processes comprising a support and an image-receiving layer incorporating a hydrophilic colloid, a non-polymeric phosphonium mordanting agent comprising at least one long chain hydrocarbon group and capable of fixing acid image dyes transferred to said image-receiving layer by diffusion, and a polymer comprising free acid groups, wherein said polymer is a copolymer latex comprising free weak acid groups and said image-receiving layer also comprises at least one heterocyclic compound corresponding to one of the following general formulae I, II, and III :

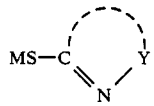

(I)

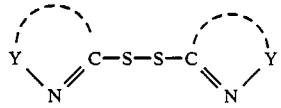

(II)

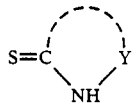

(III)

wherein:

Y represents the non-metallic atoms needed to complete a saturated or unsaturated 5- or 6-membered heterocyclic nucleus, which may carry a fused-on aromatic ring system, and M represents hydrogen, an alkali metal atom, a quaternary ammonium group, or a negative charge forming an inner salt with a quaternized nitrogen atom of the heterocyclic compound.

2. An image receptor element according to claim 1, wherein said non-polymeric phosphonium mordanting agent corresponds to the following general formula:

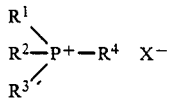

wherein:

each of $R^1$, $R^2$, and $R^3$ (same or different) represents $C_1$–$C_8$ alkyl, cycloalkyl, or aryl.

$R^4$ represents alkyl having at least 10 carbon atoms or alkenyl having at least 10 carbon atoms and $X^-$ is an acid anion.

3. An image receptor element according to claim 1, wherein said non-polymeric phosphonium mordanting agent is tri-n-butyl-n-hexadecyl-phosphonium bromide.

4. An image receptor element according to claim 1, wherein said copolymer latex comprising free weak acid groups is a copolymer latex comprising carboxylic acid groups.

5. An image receptor element according to claim 1, wherein said heterocyclic compound is of the triazole, triazoline, triazolium inner salt, or triazine type.

6. An image receptor element according to claim 1, wherein said hydrophilic colloid is gelatin.

7. An image receptor element according to claim 1, wherein said non-polymeric phosphonium mordanting agent is present in said image-receiving layer in amounts varying from about 1.5 to about 3 g per $m^2$.

8. An image receptor element according to claim 1, wherein said copolymer latex comprising free weak acid groups is present in said image-receiving layer in amounts varying from about 30 to 70% by weight, calculated on the amount of non-polymeric phosphonium mordanting agent present.

9. Monosheet light-sensitive colour photographic element comprising as integrating constituents a light-sensitive element comprising a support, at least one silver halide emulsion layer, and associated with said silver halide emulsion layer a non-diffusing dye-providing substance that is capable of releasing in image-wise distribution a diffusible acid dye upon development, as well as an image receptor element comprising an image-receiving layer incorporating a hydrophilic colloid, a non-polymeric phospoium mordanting agent comprising at least one long chain hydrocarbon group and capable of fixing said acid dye transferred to said image-receiving layer by diffusion, a copolymer latex comprising free weak acid groups, and at least one heterocyclic compound, wherein said heterocyclic compound corresponds to one of the following general formulae I, II, and III:

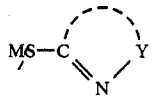
(I)

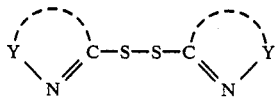
(II)

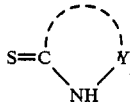
(III)

wherein:

Y represents the non-metallic atoms needed to complete a saturated or unsaturated 5- or 6-membered heterocyclic nucleus, which may carry a fused-on aromatic ring system, and M represents hydrogen, an alkali metal atom, a quaternary ammonium group, or a negative charge forming an inner salt with a quaternized nitrogen atom of the heterocyclic compound.

10. Dye diffusion transfer imaging process comprising image-wise exposing a light-sensitive colour photographic element comprising a support, at least one silver halide emulsion layer, and associated with said silver halide emulsion layer a non-diffusing dye-providing substance that is capable of releasing in image-wise distribution a diffusible acid dye upon development, developing said image-wise exposed element, and transferring image-wise by diffusion said acid dye to an image-receiving layer incorporating a non-polymeric phosphonium mordanting agent comprising at least one long chain hydrocarbon group and a copolymer latex comprising free weak acid groups as a stabilizer for the mordanting agent, wherein the image-wise transfer of said acid dye is performed in the presence of at least one heterocyclic compound corresponding to one of the general formulae I, II, and III

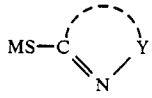
(I)

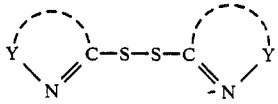
(II)

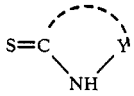
(III)

wherein:

Y represents the non-metallic atoms needed to complete a saturated or unsaturated 5- or 6-membered heterocyclic nucleus, which may carry a fused-on aromatic ring system, and M represents hydrogen, an alkali metal atom, a quaternary ammonium group, or a negative charge forming an inner salt with a quaternized nitrogen atom of the heterocyclic compound.

11. A process according to claim 10, wherein said heterocyclic compound is present in a bath applied during said image-wise transfer.

* * * * *